US007281947B2

(12) United States Patent
Pescatore

(10) Patent No.: US 7,281,947 B2
(45) Date of Patent: Oct. 16, 2007

(54) SELF-LOCKING ELECTRICAL CONNECTOR

(75) Inventor: Roy Joseph Pescatore, Saugus, MA (US)

(73) Assignee: M/A-Com, Inc., Lowell, MA (US)

( * ) Notice: Subject to any disclaimer, the term of this patent is extended or adjusted under 35 U.S.C. 154(b) by 0 days.

(21) Appl. No.: 11/264,233

(22) Filed: Nov. 1, 2005

(65) Prior Publication Data

US 2007/0042641 A1 Feb. 22, 2007

Related U.S. Application Data

(60) Provisional application No. 60/708,453, filed on Aug. 16, 2005.

(51) Int. Cl.
*H01R 9/05* (2006.01)

(52) U.S. Cl. ..... 439/578; 439/320; 439/321; 439/322

(58) Field of Classification Search ..... 439/321, 439/320, 322, 578
See application file for complete search history.

(56) References Cited

U.S. PATENT DOCUMENTS

| | | | | |
|---|---|---|---|---|
| 4,676,573 | A * | 6/1987 | Norman | 439/318 |
| 4,941,846 | A * | 7/1990 | Guimond et al. | 439/578 |
| 5,195,905 | A | 3/1993 | Pesci | |
| 5,971,787 | A * | 10/1999 | Brown | 439/321 |
| 6,086,282 | A | 7/2000 | Dutt et al. | |
| 6,293,595 | B1 * | 9/2001 | Marc et al. | 285/92 |
| 6,557,900 | B1 * | 5/2003 | Austin | 285/92 |

FOREIGN PATENT DOCUMENTS

EP 0 510 240 B2 9/2000

* cited by examiner

*Primary Examiner*—Tho D. Ta

(57) ABSTRACT

A self-locking electrical connector is provided that includes a coupling nut and a locking sleeve positionable in one of a locked position and an unlocked position. At least a portion of the coupling nut is engaged by the locking sleeve when the locking sleeve is in the locked position.

17 Claims, 4 Drawing Sheets

SELF-LOCKING ELECTRICAL CONNECTOR

CROSS REFERENCE TO RELATED APPLICATIONS

This application claims priority to and the benefit of the filing date of U.S. Provisional Application No. 60/708,453, filed on Aug. 16, 2005 and which is hereby incorporated by reference in its entirety.

BACKGROUND OF THE INVENTION

This invention relates generally to electrical connectors, and more particularly, to a self-locking coaxial connector.

Different types and configurations of connectors are known for interconnecting electrical components such as coaxial cables and/or circuit boards. Generally, coaxial cables have a circular geometry formed with a central conductor having one or more conductive wires surrounded by a cable dielectric material. The dielectric material is surrounded by a cable braid that serves as a ground, and the cable braid is surrounded by a cable jacket. In most coaxial cable applications, it is preferable to match the impedance between source and destination electrical components located at opposite ends of the coaxial cable. Consequently, when sections of coaxial cable are interconnected by connector assemblies, or when the coaxial cable is connected to a connector assembly for use with a circuit board, it is preferable that the impedance remain matched through the interconnection.

Coaxial connectors for interconnecting electrical components typically include a conductive signal path and a conductive shield surrounding the signal path. The conductive path through the shield provides a return path through the connector and also prevents radio frequency (RF) leakage from the signal path. Sometimes referred to as RF connectors, coaxial connectors are used with and are employed in a wide variety of electrical and electronic devices and packages.

Today, coaxial cables are widely used in many different applications. Demand has increased for RF transmission via coaxial cables and circuit boards in, for example, automotive and telecommunications applications. The increased demand for RF transmissions in these industries is due in part to the advancements made in the electrical content within various equipment, such as audio systems, cellular phones, GPS, satellite radios, Blue Tooth™ compatibility systems and the like. The wide applicability of coaxial transmission systems demands that connected coaxial cables reliably maintain the interconnection.

In order to maintain the coaxial connector interface connection it is known to tie wire the coupling nut to the mating connector. This tie wiring operation can be extremely difficult to perform, for example, in small or tight places. The difficulty of the operation can add time and cost to the assembly and process for connection. Additionally, the tie wire may loosen over time, thereby resulting in the coaxial connector interface becoming loosed. This loosening can result in improper operation of the coaxial connection or complete failure. Thus, known coaxial connectors often are difficult to install and may not reliably function over time.

BRIEF DESCRIPTION OF THE INVENTION

In an exemplary embodiment, an electrical connector is provided that includes a coupling nut and a locking sleeve positionable in one of a locked position and an unlocked position. At least a portion of the coupling nut is engaged by the locking sleeve when the locking sleeve is in the locked position.

In another exemplary embodiment, a coaxial connector is provided that includes a coupling nut, a locking outer shell engaged with the coupling nut and a locking sleeve slidably and rotationally engaged with the locking outer shell. The coaxial connector further includes a spring within the locking outer shell. The spring is in compressed state in an unlocked position of the locking sleeve. The locking sleeve is movable between the unlocked position, wherein the coupling nut is freely rotatable, and a locked position, wherein the coupling nut is engaged by and at least partially contained within the locking sleeve to prevent rotation of the coupling nut. Movement between the unlocked position and the locked position is caused by rotational and sliding movement of the locking sleeve.

In still another exemplary embodiment, a method of providing connection of coaxial cables is provided. The method includes configuring a connector to lock (i) a coupling nut in connection with a first coaxial cable and (ii) a locking outer shell in connection with a second coaxial cable upon rotation and translation of the connector between an unlocked position and a locked position. The method further includes configuring the connector to engage and at least partially cover the coupling nut in the locked position.

DETAILED DESCRIPTION OF THE INVENTION

Various embodiments of the present invention provide an electrical connector, and more particularly, a self-locking radio frequency (RF) connector for connecting coaxial cables or wires. The self-locking RF connector eliminates the use of tie wiring for the connector interface. The various embodiments do not include a tie wire to lock the coupling nut of the connector interface to another connector. It should be noted that the various embodiments of the present invention may be implemented in connection with any type or configuration of RF or coaxial connector interface including, for example, N connectors, BNC or TNC connectors, ETNC connectors, SMA, SMB or SMC connectors, F connectors, etc. In general, the various embodiments may be implemented with a connector for use in connecting any electrical cables, any two coaxial cables or wires and/or any two connector interfaces.

Figure 1:
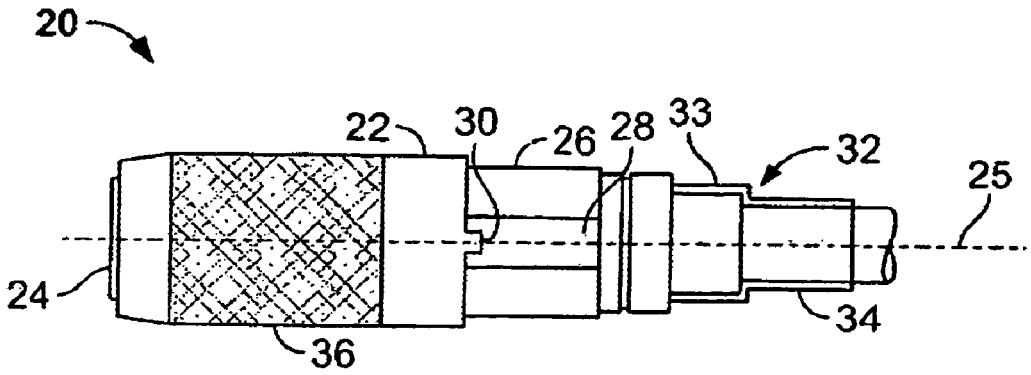
FIG. 1 is a side elevational view of a locking connector constructed in accordance with an exemplary embodiment of the invention in a locked position.
Figure 2:
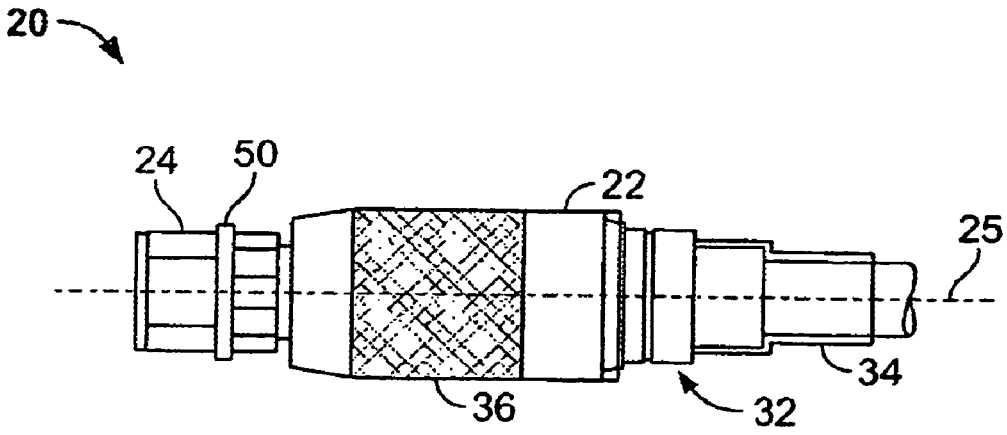
FIG. 2 is a side elevational view of a locking connector constructed in accordance with an exemplary embodiment of the invention in an unlocked position.

In general, various embodiments of the present invention provide an electrical connector, and more particularly, a self-locking connector 20, having a self-locking connector interface operable between a locked position shown in FIG. 1 and an un-locked position shown in FIG. 2. Specifically, and as shown in FIGS. 1 and 2, the self-locking connector 20 generally includes a locking sleeve 22 and a coupling nut 24. The coupling nut 24 is substantially aligned along a longitudinal axis 25 extending through the locking sleeve 22. The locking sleeve 22 is slidably and rotatably engaged to a locking outer shell 26. The locking outer shell 26 includes a groove 28 extending longitudinally along an outer surface of the locking outer shell 26. The groove 28 is configured for receiving therein a tab 30 of the locking sleeve 22. The tab 30 also operates as a circumferential rotation alignment member as described in more detail herein. It should be noted that more than one tab 30 and more than one groove 28 may be provided. For example, two tabs 30 and two corresponding grooves 28 may be provided 180 degrees apart.

The self-locking connector 20 also includes a back end 32 defining a boot 33 having tubing 34 extending therefrom. An outer surface of the locking sleeve 22 may include a gripping portion 36 extending circumferentially around the outer surface and at least partially longitudinally along the outer surface. The gripping portion 36 may be formed of different materials as desired or needed, for example, a diamond knurl to facilitate gripping by a user.

Figure 3:
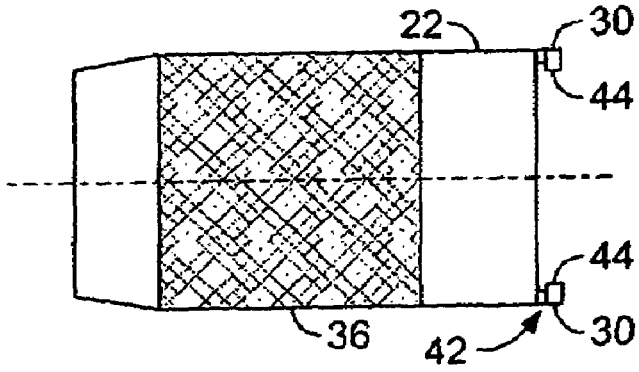
FIG. 3 is a side elevational view of a locking sleeve constructed in accordance with an exemplary embodiment of the invention.
Figure 4:
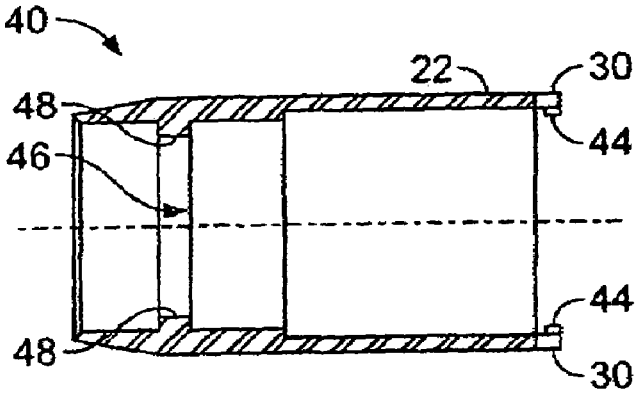
FIG. 4 is a cross-sectional view of the locking sleeve shown in FIG. 3.
Figure 5:
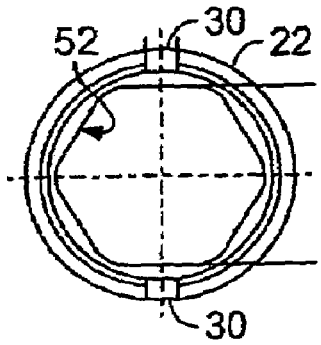
FIG. 5 is a back end plan view of the locking sleeve shown in FIG. 3.

The locking sleeve 22, as shown in FIGS. 3 and 4, includes a front end 40, which may be generally tapered, for receiving therethrough the coupling nut 24. The locking sleeve 22 also includes at a back end 42 the tabs 30. In various embodiments the tabs 30 are configured having an inwardly projecting engagement portion 44, which may be defined by, for example, a lip or shoulder. The inner passage of the locking sleeve 22 has a smaller diameter at the front end 40 than the back end 42 and includes a coupling nut 24 receiving portion 46 having an inner rim 48 for engaging (e.g., abutting against) an outer rim 50 (shown in FIGS. 1 and 2) of the coupling nut 24. In the various embodiments, the inner rim 48 defines a hexagonal opening 52 as shown in FIG. 5.

Figure 6:
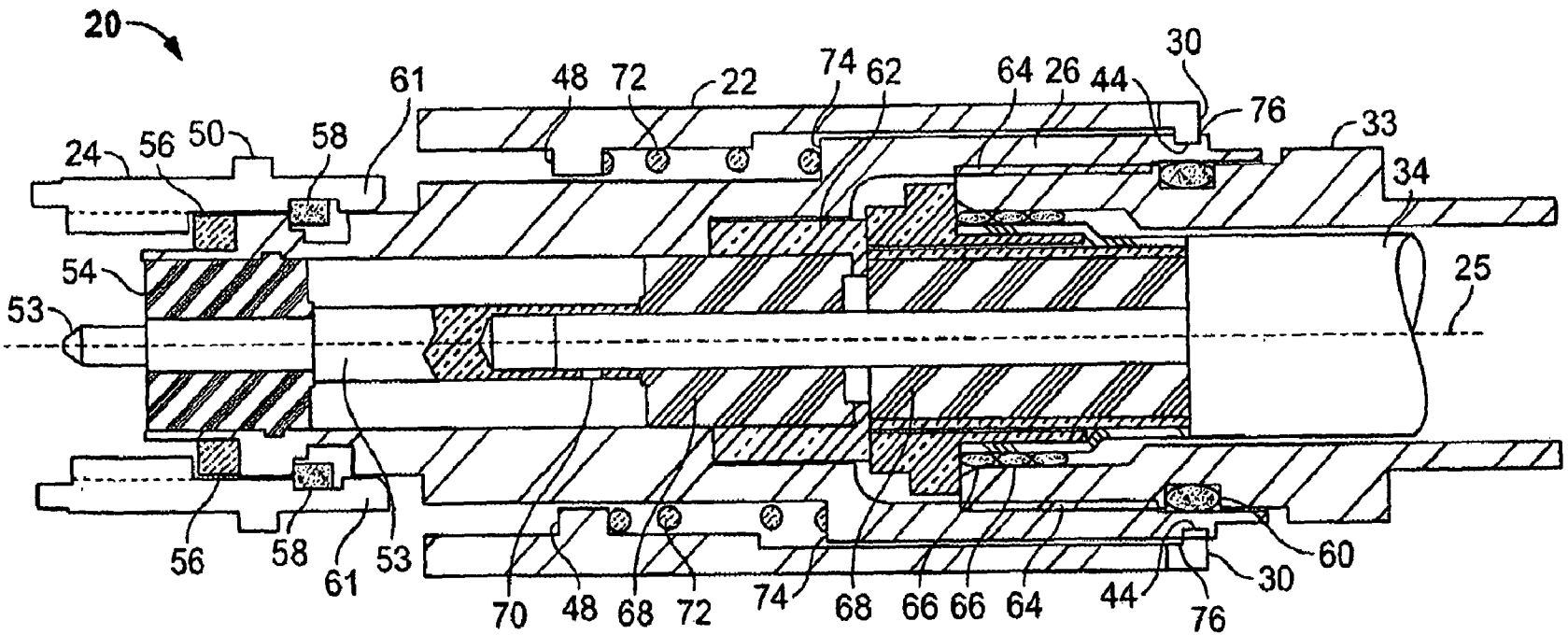
FIG. 6 is a cross-sectional view of the locking connector shown in FIGS. 1 and 2.

As shown in FIG. 6, the coupling nut 24 engages the locking outer shell 26 and includes a contact pin 53 therein. A pin support member 54 maintains the position of the contact pin 53 generally at a center of the coupling nut 24. A sealing gasket 54 seals an inner interface between the coupling nut 24 and the locking outer shell 26. A snap ring 58 provides locking engagement of the coupling nut 24 to the locking outer shell 26. It should be noted that a rim 61 of the coupling nut 24 defines a hexagonal outer surface complementary to the hexagonal opening 52 of the locking sleeve 22.

The boot 33 engages the locking outer shell 26 at the back end 32 with the interface between the boot 33 and the locking outer shell 26 sealed by a sealing member 60, such as, for example, an O-ring. A retaining sleeve 62 is also provided to maintain the positioning of the boot 33 and the locking outer shell 26. A sealing or adhesive material 64 (e.g., Loctite adhesive) may be provided to adhere the boot 33 and the locking outer shell 26. Additional sealing members 66 (e.g., O-rings), may be provided to seal the boot 33 and the retaining sleeve 62. Further, an insulator 68 is provided to insulate the contact pin 53 from the locking outer shell 26 and the boot 33. It should be noted that solder or a thread may be used to maintain the connection of the contact pin 53 within the self-locking connector 20. An opening 70 also may be provided through a portion of the contact pin 53.

The locking outer shell 26 also includes a circumferentially extending groove 76 for receiving therein the engagement portion 44 of the tab 30. A spring 72, for example, a compression spring is provided between the inner rim 48 and a shoulder portion 74 of the locking outer shell 26. It should be noted that the spring 72 is in a compressed state when the self-locking connector 20 is in the unlocked position and in an extended state when the self-locking connector 20 is in the locked position.

Thus, the locking outer shell 26 having the coupling nut 24 at one end and the boot 33 at the other end is configured to provide (i) translational or sliding movement and (ii) rotational movement relative to the locking sleeve 22. This movement provides self-locking operation of the self-locking connector 20 to translate the locking sleeve 22 and engage and lock the coupling nut 24 to the locking sleeve 22. The locking sleeve 22 is configured in the locked to position to resist or prevent access to the coupling nut 24 by a user.

Figure 7:
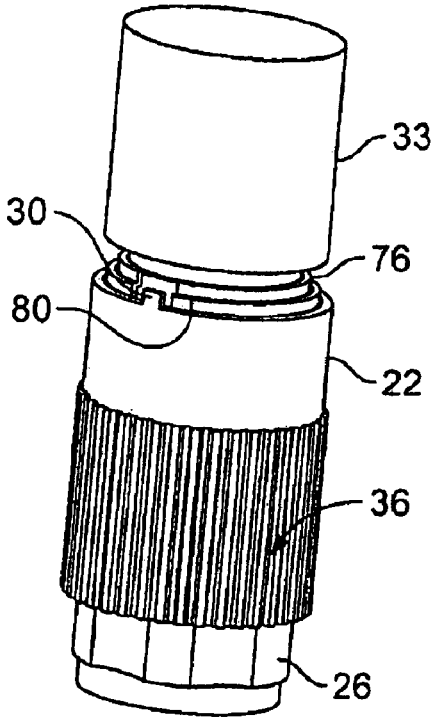
FIG. 7 is a perspective view of a locking connector constructed in accordance with an exemplary embodiment of the invention in an unlocked position.
Figure 8:
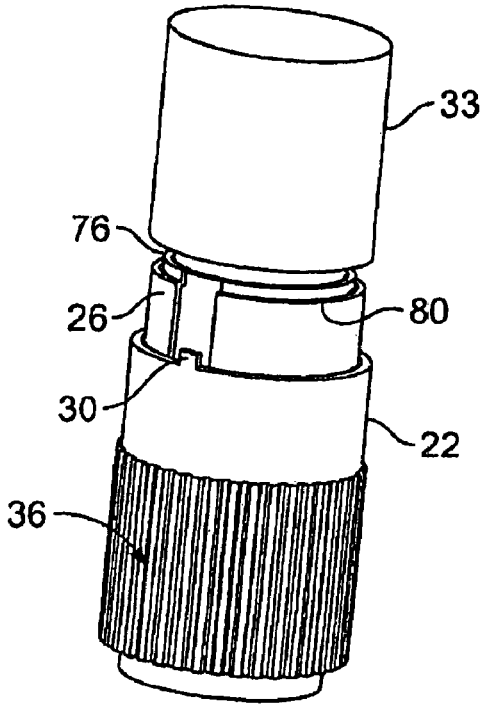
FIG. 8 is a perspective view of a locking connector constructed in accordance with an exemplary embodiment of the invention in a locked position.

Specifically, in operation, the self-locking connector 20 is configured for operation between an unlocked position shown in FIG. 7 and a locked position shown in FIG. 8. In particular, when the locking sleeve 22 is in the unlocked position, the coupling nut 24 is capable of rotation (e.g., unrestricted rotation) to provide mating of the coupling nut 24 to, for example, a female connecting member or interface. In the unlocked position the tabs 30 are engaged in the groove 76 to resist the resilient force of the spring 72 (shown in FIG. 6). Specifically, the inwardly projecting engagement portion 44 (shown in FIGS. 3 and 4) engage a rim 80 of the groove 76. The engagement of the inwardly projecting engagement portion 44 with the rim 80 prevents translational or sliding movement of the locking sleeve 22. In this unlocked position, the self-locking connector 20 may be tightened to a mating connector of, for example, another connecter (e.g., N connector). For example, a torque wrench may be used to tighten to a specified force (e.g., twenty-three inch-pounds) the coupling nut 24 to another connector.

To lock the self-locking connector 20, and more particularly, to move the locking sleeve 22 into the locked-position, a user rotates the locking sleeve 22. Specifically, the user rotates the locking sleeve 22 relative to the locking outer shell 26 such that the tab 30 rotates circumferentially within the groove 76. The tab 30 rotates (e.g., counterclockwise) until the tab 30 reaches the groove 28, at which point, the force of the spring 72 causes the locking sleeve 22 to translate or move longitudinally until the outer rim 50 (shown in FIG. 6) of the coupling nut 24 engages the inner rim 48 (shown in FIG. 6) of the locking outer shell 26. Further, the hexagonal outer surface of the rim 61 engages within the inner rim 48 (shown in FIG. 6) of the locking sleeve 22 that defines a complementary hexagonal opening 52. This complementary locking engagement maintains and locks the coupling nut 24 within the locking sleeve 22. This complementary locking arrangement also prevents rotational movement of the coupling nut 24. Essentially, when in the locked position, the force of the spring 72 maintains the locking sleeve 22 in engagement with the coupling nut 24, and also may cover or encompass at least a portion of the coupling nut 24.

Thus, the hexagonal inner shape of the locking sleeve 22 abuts and/or overlaps flat portions on the back of the coupling nut 24 to maintain the locked position. Additionally, the locking sleeve 22 engages and/or overlaps the external hexagonal shape on the front of the coupling nut 24 to resist and/or prevent disengagement of the connection interface formed by the self-locking connector 20. The self-locking connector 20 thereby provides an automatic locking function once the locking sleeve 22 is rotated from the unlocked position.

To move the self-locking connector 20 back to the unlocked position, a user slides the locking sleeve 22 longitudinally along the groove 28 until the tab 30 reaches an end of the groove 28, which prevents further sliding movement of the locking sleeve 22. Essentially, the user is pulling back the locking sleeve 22 against the force of the spring 72. At this point, the user rotates the locking sleeve 22 (e.g., clockwise) such that the tab 30 rotates circumferentially within the groove 76. This again engages the tabs 30 in the groove 76 to resist the resilient force of the spring 72 and resists and/or prevents translational or sliding movement of the locking sleeve 22. It should be noted that the grove 76 may include a stop or other similar member to stop the rotation of the locking sleeve 22 when abutted by the tabs 30, for example, after a quarter turn.

It further should be noted that the various component parts of the self-locking connector 20 may be constructed of different materials as desired or needed. For example, different types of stainless steel may be used depending on the particular application for the self-locking connector 20. Additionally, the size and shape of the various component parts may be modified as desired or needed. For example, the size of the opening of the locking sleeve 22 and the size of the coupling nut 26 may be modified based on the type of connection to be made. In general, the locking sleeve 22 and coupling nut 26 may be modified to connect to different types of other connectors. Additionally, the shape of the engagement portions, described herein as hexagonal, may be modified to different shapes, such as, for example, octagonal.

Thus, various embodiments of the invention provide a self-locking connector having a rotatable and translatable locking sleeve that allows self-locking operation. The locking sleeve engages and contains therein at least a portion of the coupling nut when in the locked position to prevent disengagement of the coupling nut from another connector and to prevent unintended additional tightening of the connector connected to the coupling nut. In various embodiments, in the locked position, the coupling nut may be covered or encompassed partially, substantially or entirely by the locking sleeve.

While the invention has been described in terms of various specific embodiments, those skilled in the art will recognize that the invention can be practiced with modification within the spirit and scope of the claims.

What is claimed is:

1. An electrical connector comprising:

a coupling nut; and a locking sleeve positionable in one of a locked position and an unlocked position, and wherein the coupling nut is not covered by the locking sleeve when the locking sleeve is in the unlocked position and at least a portion of the coupling nut is engaged by the locking sleeve to prevent disengagement of the coupling nut from a mating connector or to prevent unintended additional tightening of the mating connector connected to the coupling nut when the locking sleeve is in the locked position, the locking sleeve covering and configured to prevent access to the coupling nut when the locking sleeve is in the locked position.

2. An electrical connector in accordance with claim 1 wherein a portion of the coupling nut is at least partially encompassed by the locking sleeve when the locking sleeve is in the locked position.

3. An electrical connector in accordance with claim 1 wherein the locking sleeve is configured to allow slidable movement between the locked and unlocked positions.

4. An electrical connector in accordance with claim 1 further comprising a spring within the locking sleeve, the spring in a compressed state in the unlocked position.

5. An electrical connector in accordance with claim 1 further comprising a spring within the locking sleeve, the spring maintaining engagement of the locking sleeve with the coupling nut in the locked position.

6. An electrical connector in accordance with claim 1 wherein the coupling nut is configured to provide unrestricted rotation when the locking sleeve is in the unlocked position.

7. An electrical connector in accordance with claim 1 wherein the locking sleeve includes a hexagonal shaped end, the coupling nut having a complementary hexagonal shaped portion for engaging the hexagonal shaped end in the locked position.

8. An electrical connector in accordance with claim 1 further comprising a gripping portion on an outer surface of the locking sleeve.

9. An electrical connector in accordance with claim 1 further comprising a locking outer shell having a groove for moving the locking sleeve between the locked and unlocked positions.

10. An electrical connector in accordance with claim 9 wherein the locking sleeve further comprises a tab, the groove configured to receive the tab therein.

11. An electrical connector in accordance with claim 1 further comprising a locking outer shell having a longitudinal groove providing slidable movement of the locking sleeve between the locked and unlocked positions, the locking outer shell having a circumferential groove providing rotatable movement of the locking sleeve.

12. An electrical connector in accordance with claim 11 wherein the longitudinal groove and circumferential groove having a common portion and the locking sleeve is rotatable in the circumferential groove and translatable in the longitudinal groove when moving from the unlocked position to the locked position.

13. An electrical connector in accordance with claim 12 wherein the locking sleeve further comprises a tab having an inwardly projecting engagement portion configured to engage a rim of the circumferential groove to prevent movement from the unlocked position to the locked position.

14. A coaxial connector comprising:

a coupling nut;

a locking outer shell engaged with the coupling nut;

a locking sleeve slidably and rotationally engaged with the locking outer shell; and a spring within the locking outer shell, the spring in compressed state in an unlocked position of the locking sleeve, the locking sleeve movable between the unlocked position, wherein the coupling nut is freely rotatable, and a locked position, wherein the coupling nut is engaged by and at least partially contained within the locking sleeve to prevent rotation of the coupling nut, movement between the unlocked position and the locked position caused by rotational and sliding movement of the locking sleeve.

15. A coaxial connector in accordance with claim 14 wherein the locking sleeve is first rotated and then extended by sliding movement when moving between the unlocked position and the locked position.

16. A coaxial connector in accordance with claim 14 wherein the locking outer shell comprises a circumferential groove providing rotational movement of the locking sleeve and a longitudinal groove providing sliding movement of the locking sleeve.

17. A coaxial connector in accordance with claim 16 wherein the locking sleeve comprises at least one tab configured to engage the circumferential groove and align the locking sleeve with the longitudinal groove to provide the sliding movement of the locking sleeve.

* * * * *